US005158562A

United States Patent [19]

Bertram et al.

[11] Patent Number: 5,158,562

[45] Date of Patent: Oct. 27, 1992

[54] EPILATING DEVICE HAVING EPILATING ROLLERS ROTATINGLY DRIVABLE IN OPPOSITE DIRECTIONS

[75] Inventors: Leo Bertram, Stolberg, Fed. Rep. of Germany; Hugo Schemmann, Schaesberg, Netherlands; Romuald L. Bukoschek, Klagenfurt, Austria

[73] Assignee: U.S. Philips Corp., New York, N.Y.

[21] Appl. No.: 507,948

[22] Filed: Apr. 10, 1990

[30] Foreign Application Priority Data

Apr. 29, 1989 [DE] Fed. Rep. of Germany ... 8905479[U]

[51] Int. Cl.[5] ..... A45D 26/00

[52] U.S. Cl. ..... 606/133; 606/131

[58] Field of Search ..... 606/131, 133; 132/73; 30/34.2, 43.6, 43.5, 43.9; 310/331, 41; 81/3.2; 17/11.1

[56] References Cited

U.S. PATENT DOCUMENTS

| | | | |
|---|---|---|---|
| 3,715,803 | 2/1973 | Tyler | 30/43.5 |
| 4,038,747 | 8/1977 | Upton | 30/34.2 |
| 4,279,253 | 7/1981 | Haes et al. | 606/133 |
| 4,830,004 | 5/1989 | Alazet | 606/133 |
| 4,917,678 | 4/1990 | Locke et al. | 606/133 |

FOREIGN PATENT DOCUMENTS

| | | | |
|---|---|---|---|
| 2079667 | 11/1971 | France . | |
| 0652899 | 12/1985 | Switzerland | 606/133 |

*Primary Examiner*—Stephen C. Pellegrino
*Assistant Examiner*—Glenn K. Dawson
*Attorney, Agent, or Firm*—Ernestine C. Bartlett

[57] ABSTRACT

The invention relates to an epilating device having epilating rollers which are drivable in opposite directions, at the periphery have a wave-shaped cross-sectional profile, mesh together at their periphery by their cross-sectional profiles and are drivable by means of a motor, a single-phase synchronous motor without a non-reverse mechanism being provided for the purpose of driving an uneven number of epilating rollers.

3 Claims, 1 Drawing Sheet

EPILATING DEVICE HAVING EPILATING ROLLERS ROTATINGLY DRIVABLE IN OPPOSITE DIRECTIONS

FIELD OF THE INVENTION

This invention relates to an epilating device having epilating rollers which are rotatingly drivable in opposite directions, at their periphery have a wave-shaped cross-sectional profile, mesh together at their periphery by their cross-sectional profiles and are drivable by means of a motor.

BACKGROUND OF THE INVENTION

An epilating device having epilating rollers arranged in pairs is known from FR-PS 2,079,667. The epilating rollers have a wave-shaped roller profile twisted in the form of a helix over the length of the epilating rollers. The profiles of the epilating rollers, which are arranged next to one another in pairs, engage into one another, with the result that the rollers mesh with one another. To make the epilating action possible, the rollers must be driven by a motor which causes the rollers to run together away from the skin. Hairs clamped between the epilating rollers can thereby be torn out of the skin. To guarantee this direction of rotation, it must be ensured that the motor always starts in the same direction of rotation.

As regards their power-to-volume ratio, customarily employed motors designed for mains operation are relatively bulky or uneconomical. Since the housing of an epilating device in which the motor is situated is customarily held in the hand, this bulky construction is troublesome.

SUMMARY OF THE INVENTION

An object of the invention is to create an epilating device of the type having rollers which are rotatingly drivable in opposite directions, which at their periphery have a wave-shaped cross-sectional profile, mesh together at their periphery by their cross-sectional profiles, and are drivable by means of a motor which epilating device is designed for mains operation and represents a small, easy-to-handle device with an economical, low-loss drive. This and other objects are achieved according to the innovation by the fact that an uneven number of epilating rollers and, for driving, a single-phase synchronous motor without a non-reverse mechanism are provided. By virtue of the use of a single-phase synchronous motor, which is of simple construction and of small size, it is possible to use the single-phase synchronous motor without a non-reverse mechanism in conjunction with an uneven number of epilating rollers. Irrespective of the direction of rotation of the motor, one pair of rollers will always run together in front of the skin and thus bring about the epilating effect. A simple, small and easy-to-handle device which operates quietly is obtained. This is because a non-reverse mechanism is always a source of noise, which is active precisely during the starting operations and during these can be acoustically irritating. Due to the high efficiency of the motor, the thermal losses are low. An impermissible heating up of the device can be avoided.

According to a further embodiment of the invention it is envisaged that the shaft of the single-phase synchronous motor meshes with one of the epilating rollers via an intermediate gear. The speed of the epilating rollers can here be adjusted to a different speed, as desired, without artificial speed control. However, when a high speed of rotation of the epilating rollers is important, then provision is made, according to a further embodiment of the invention, for one of the epilating rollers of a set of rollers to be driven directly by the shaft of the single-phase synchronous motor.

BRIEF DESCRIPTION OF THE DRAWING

The invention is explained in greater detail with reference to the drawing, in which.

DETAILED DESCRIPTION OF PREFERRED EMBODIMENTS

Figure 1:
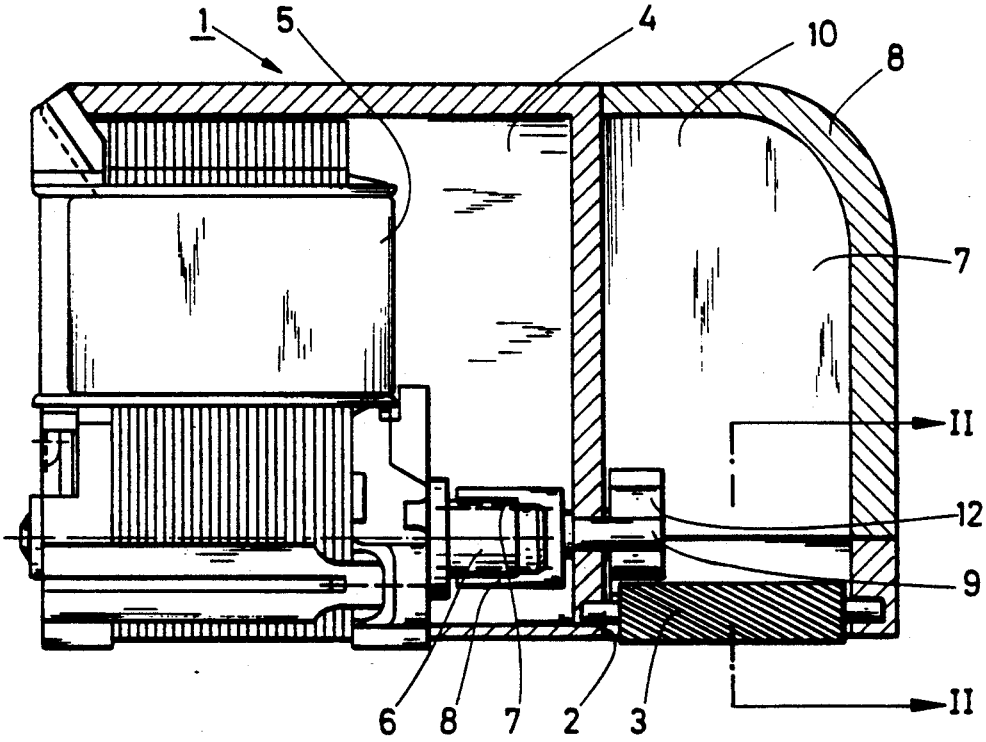
FIG. 1 shows a section through an epilating device which is provided with epilating rollers which are driven by a single-phase synchronous motor.

FIG. 1 shows the housing 1 of an epilating device, which has a housing aperture 2 in which epilating rollers 3 are rotatably arranged. In the sectional view according to FIG. 1, only one epilating roller 3 can be seen.

In the motor compartment 4 of the housing 1 there is a single-phase synchronous motor 5, the shaft 6 of which is provided with a moulded-on gear toothing 7. Over the gear toothing 7 there engages a cap-type gear 8 which carries a shaft 9 which extends into an epilating chamber 10. In the epilating chamber 10, there is an intermediate gear 12 on the shaft 9. This intermediate gear 12 meshes with the central gear 3 of a set 13 of epilating rollers. For this purpose, gear 12 is provided with a surface which corresponds to that of the epilating rollers 3. Gear 12 can therefore be in meshing engagement with the central epilating roller.

Figure 2:
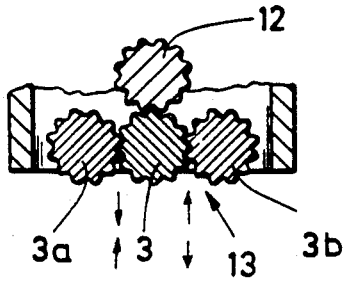
FIG. 2 shows an arrangement of three epilating rollers in section.

The profiling of the epilating rollers 3, **3*a* and 3*b* of the set 13 of epilating rollers according to FIG. 2** has a wave-shaped cross-sectional profile, for example of sinusoidal configuration, with the result that in the region of their maximum diameter, on the one hand, and in the region of their minimum diameter, on the other hand, the epilating rollers fit snugly together as they roll against one another. This snugly fitting rolling is of great importance for a good epilating effect.

Figure 3:
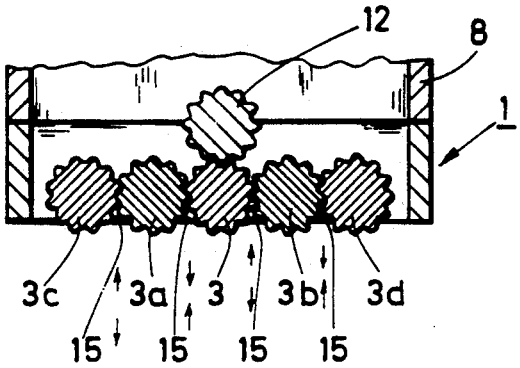
FIG. 3 shows an arrangement of five epilating rollers in section.

FIG. 3 shows a further section through the epilating device according to FIG. 1, in this case, however, having five epilating rollers **3*a* to 3*d* arranged next to one another and fitting snugly together as they roll against one another. The epilating rollers are again driven via the intermediate gear 12 arranged on the shaft 9, as in the construction according to FIG. 2**.

The single-phase synchronous motor 5 operates without a non-reverse mechanism. This means that the rotor can start in any desired direction of rotation. When an uneven number of epilating rollers is used, as illustrated in FIGS. 2 and 3, one of the pairs of rollers in FIG. 2 is always driven in the trapping direction and the other counter to the trapping direction. In the embodiment according to FIG. 3, having five rollers, an analogous statement applies. Depending on the direction of rotation employed, two trapping slits 15 are always in each case driven in the trapping direction and two in each case driven counter to the trapping direction.

We claim:

1. An epilating device having a housing comprising an epilating chamber with an uneven number of a plurality of epilating rollers arranged at a housing aperture, and comprising a motor compartment in which there is mounted a reversible single-phase synchronous motor having a motor shaft and a rotor, said motor shaft comprising gear toothing which engages a gear mounted on said motor shaft, said gear comprising a gear shaft which is an extension of said motor shaft and extends into said epilating chamber, said gear shaft carrying an intermediate gear which meshes with a central roller of said plurality of epilating rollers present at said aperture, at least one pair of the rollers being driven in a direction suitable for trapping body hair between at least two of the rollers, irrespective of the starting direction of rotation of the rotor.

2. An epilating device as claimed in claim 1 wherein three rollers are driven.

3. An epilating device as claimed in claim 1 within five rollers are driven.

* * * * *